US011186800B2

(12) United States Patent
Kirsch

(10) Patent No.: US 11,186,800 B2
(45) Date of Patent: Nov. 30, 2021

(54) METALWORKING FLUID

(71) Applicant: Henkel AG & Co. KGaA, Duesseldorf (DE)

(72) Inventor: Gabriel J. Kirsch, Strongsville, OH (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/008,714

(22) Filed: Jun. 14, 2018

(65) Prior Publication Data

US 2018/0291301 A1 Oct. 11, 2018

Related U.S. Application Data

(63) Continuation of application No. PCT/US2016/061051, filed on Nov. 9, 2016.

(60) Provisional application No. 62/270,101, filed on Dec. 21, 2015.

(51) Int. Cl.

| | |
|---|---|
| ***C10M 133/04*** | (2006.01) |
| ***C10M 129/38*** | (2006.01) |
| ***C10M 129/48*** | (2006.01) |
| ***C10M 169/04*** | (2006.01) |
| ***C10M 173/00*** | (2006.01) |
| *C10N 30/00* | (2006.01) |
| *C10N 40/20* | (2006.01) |
| *C10N 40/24* | (2006.01) |
| *C10N 30/04* | (2006.01) |
| *C10N 30/12* | (2006.01) |
| *C10N 30/18* | (2006.01) |

(52) U.S. Cl.

CPC ..... *C10M 133/04* (2013.01); *C10M 129/38* (2013.01); *C10M 129/48* (2013.01); *C10M 169/04* (2013.01); *C10M 173/00* (2013.01); *C10M 2203/1006* (2013.01); *C10M 2207/021* (2013.01); *C10M 2207/04* (2013.01); *C10M 2207/125* (2013.01); *C10M 2207/126* (2013.01); *C10M 2207/127* (2013.01); *C10M 2207/128* (2013.01); *C10M 2207/142* (2013.01); *C10M 2207/18* (2013.01); *C10M 2209/103* (2013.01); *C10M 2209/108* (2013.01); *C10M 2215/02* (2013.01); *C10M 2215/04* (2013.01); *C10M 2215/042* (2013.01); *C10M 2215/044* (2013.01); *C10M 2215/06* (2013.01); *C10M 2215/064* (2013.01); *C10M 2215/082* (2013.01); *C10M 2215/223* (2013.01); *C10M 2217/046* (2013.01); *C10M 2219/02* (2013.01); *C10M 2219/024* (2013.01); *C10M 2223/04* (2013.01); *C10M 2223/06* (2013.01); *C10N 2030/04* (2013.01); *C10N 2030/12* (2013.01); *C10N 2030/18* (2013.01); *C10N 2030/24* (2020.05); *C10N 2030/44* (2020.05); *C10N 2040/20* (2013.01); *C10N 2040/24* (2013.01)

(58) Field of Classification Search

CPC ..... C10N 2030/04; C10N 2030/18; C10N 2240/40; C10N 2210/01; C10N 2230/44; C10N 2230/24; C10N 2230/18; C10N 2230/12; C10N 2030/12; C10M 2207/04; C10M 2223/06; C10M 2215/064; C10M 2207/127; C10M 2203/1006; C10M 2207/021; C10M 2207/126; C10M 2207/128; C10M 2207/142; C10M 2207/18; C10M 2209/103; C10M 2215/04; C10M 2215/042; C10M 2215/06; C10M 2215/082; C10M 2215/223; C10M 2217/046; C10M 2219/02; C10M 2223/04; C10M 2215/30; C10M 2219/09; C10M 2201/062

See application file for complete search history.

(56) References Cited

U.S. PATENT DOCUMENTS

| | | | |
|---|---|---|---|
| 2,809,160 | A | 10/1957 | Stewart et al. |
| 2,809,162 | A | 10/1957 | Lowe |
| 2,810,696 | A | 10/1957 | Lowe et al. |
| 2,900,339 | A | 8/1959 | Lowe |
| 3,526,596 | A | 9/1970 | Kress et al. |

(Continued)

FOREIGN PATENT DOCUMENTS

| | | | |
|---|---|---|---|
| CN | 102482613 | A | 5/2012 |
| CN | 104120009 | A | 10/2014 |

(Continued)

OTHER PUBLICATIONS

International Search Report for PCT/US2016/061051, dated Jan. 19, 2017, 1 page.

Sarnavskaya, T. I., et al, "Volatility and Thermal Oxidative Stability of Synthetic Ester Oils". Chemistry and Technology of Fuels and Oils, vol. 11, Issue 9-10, pp. 807-810, Sep.-Oct. 1975; ISSN: 00093092; Accession No. 1976090003482—Abstract attached.

(Continued)

*Primary Examiner* — Vishal V Vasisth

(74) *Attorney, Agent, or Firm* — Mary K. Cameron

(57) ABSTRACT

A metalworking fluid includes a pH buffer system having one or more organic acids and one or more organic amines. The organic acids, which include aromatic carboxylic acids and $C_{10}$ or higher aliphatic carboxylic acids, may replace boric acid, such that boric acid may be excluded from the metalworking fluid. The organic acids may include at least one of phthalic acid, isophthalic acid, and terephthalic acid. The one or more organic amines include aliphatic and aromatic amines having an amine value of at least 50 mg KOH/g. A method of using the metalworking fluid includes shaping a metal by contacting the metal surface with a tool while cooling and lubricating at least one of the metal surface or tool with the metalworking fluid.

15 Claims, No Drawings

(56) References Cited

U.S. PATENT DOCUMENTS

| | | | |
|---|---|---|---|
| 4,342,596 | A | 8/1982 | Conner, Sr. et al. |
| 4,383,937 | A | 5/1983 | Williams |
| 4,409,113 | A | 10/1983 | Bertell |
| 4,454,050 | A | 6/1984 | Bertell |
| 4,765,917 | A | 8/1988 | Otaki et al. |
| 4,834,891 | A | 5/1989 | Eguchi et al. |
| 5,248,431 | A | 9/1993 | Fujita et al. |
| 5,318,712 | A | 6/1994 | Lange |
| 5,368,758 | A | 11/1994 | Gapinski |
| 5,585,335 | A | 12/1996 | Andrew et al. |
| 5,783,529 | A | 7/1998 | Kalhan et al. |
| 6,020,291 | A | 2/2000 | Lange et al. |
| 6,100,225 | A | 8/2000 | Kalhan et al. |
| 6,204,228 | B1 | 3/2001 | MacNeil et al. |
| 6,344,517 | B1 | 2/2002 | Quinn et al. |
| 6,475,408 | B1 | 11/2002 | Denis et al. |
| 6,511,946 | B1 | 1/2003 | Theis et al. |
| 6,525,006 | B2 | 2/2003 | Yoneta et al. |
| 2004/0242440 | A1 | 12/2004 | Okuda et al. |
| 2009/0054279 | A1 | 2/2009 | Iida et al. |
| 2009/0209441 | A1 | 8/2009 | Lange et al. |
| 2010/0264359 | A1 † | 10/2010 | Straetmans |
| 2012/0177938 | A1 | 7/2012 | Goto et al. |
| 2012/0184475 | A1 | 7/2012 | Takagi et al. |
| 2014/0326117 | A1 | 11/2014 | Takagi et al. |

FOREIGN PATENT DOCUMENTS

| | | | |
|---|---|---|---|
| DE | 102011079556 | A1 | 1/2013 |
| DE | 102011079558 | A1 | 1/2013 |
| EP | 0478617 | B1 | 6/1995 |
| EP | 1892282 | A1 | 2/2008 |
| EP | 2083064 | A1 | 7/2009 |
| EP | 2781586 | A1 | 9/2014 |
| JP | H02199199 | A | 8/1990 |
| JP | 02228394 | A † | 9/1990 |
| JP | 06212184 | A | 8/1994 |
| JP | 08157860 | A | 6/1996 |
| JP | H10316989 | A | 12/1998 |
| JP | 11279579 | A | 10/1999 |
| JP | 2000256695 | A | 9/2000 |
| JP | 2003124159 | A | 4/2003 |
| JP | 2004018758 | A | 1/2004 |
| JP | 2005089570 | A | 4/2005 |
| JP | 2007099906 | A | 4/2007 |
| JP | 2009249419 | A | 10/2009 |
| JP | 2010248329 | A | 11/2010 |
| JP | 2011079956 | A | 4/2011 |
| JP | 2014015527 | A | 1/2014 |
| JP | 2014513189 | A | 5/2014 |
| SU | 1446914 | A1 | 5/1996 |
| WO | 2007130836 | A1 | 11/2007 |
| WO | 2011111064 | A1 | 9/2011 |
| WO | 2014084171 | A1 † | 6/2014 |
| WO | 2014097871 | A1 | 6/2014 |
| WO | 2015116233 | A1 | 8/2015 |

OTHER PUBLICATIONS

Komatsuzaki, Shigeki, et al, "Flow Properties of Lubricating Greases at High Temperature—1. Appararent Viscosity at High Temperature". "Source: Journal of Japan Society of Lubrication Engineers, vol. 20, Issue 2, pp. 97-105, 1975; Accession No. 1976010003-820" —Abstract attached.

Canter, Neil, "HLB: A new system for water-based metalworking fluids". Tribology and Lubrication Technology, vol. 61, Issue 9. pp. 10-12, Sep. 2005; ISSN: 00247154; Publisher: Society of Tribologists and Lubrication Engineers; Accession No. 2005419410596—Abstract attached.

Al-Sabagh, A. M., et al, "Investigation of oil and emulsion stability of locally prepared metalworking fluids". Industrial Lubrication and Tribology, vol. 64, Issue 6, pp. 346-358, 2012; ISSN: 0036-8792; DOI: 10.1108/00368791211262480; Publisher: Emerald, UK; Accession No. 13514021 http://www.emeraldinsight.com/doi/abs/10.1108/00368791211262480 Located Via Inspec—Abstract attached.

Hunz, Roger P., "Water-Based Metalworking Lubricants". Lubrication Engineering, vol. 40, Issue 9, pp. 549-553, Sep. 1984; ISSN: 00247154; Accession No. 1984120218384 Located Via Compendex—Abstract attached.

Chen, S., et al "Influence of Type of Carboxylic Acids on Lubricity and Anti-Rust Performance of Aqueous Lubrication Fluids". China Steel Tech. Rep7 (Dec. 30, 1993): pp. 108-112; Accession No. 199408-52/1135 (MD)ProQuest document ID 26135708; Publisher China Steel Corporation; ISSN 1015-6070; http://search.proquest.com/docview/26135708?accountid=142944—Abstract attached.

Aumann, U., "Comparative study of the role of alkanolamines with regard to metalworking fluid longevity—laboratory and field evaluation". Tribology 2000-Plus: 12th International Colloquium; Ostfildern; Germany; Jan. 11-13, 2000. (Jan. 11, 2000); Accession No. 200009-52-1580 (MD); ProQuest document ID 27239238; ISBN 3924813442; http://search.proquest.com/docview/27239238?accountid=142944; Publisher Technische Akademie Esslingen, In den Anlagen—Abstract attached.

Supplementary European Search Report for EP 16879611 dated Aug. 28, 2019.

Zhao, Bingzhen, et al, "Design and Application of Modern Knives", National Defense Industry Press, Sep. 2014, pp. 398. With English machine translation.

Watanabe, Shojl "Preparation and Properties of Water-Based Cutting Fluids Additves", Department of Applied Chemistry, Faculty of Engineering, Chiba University (1999), pp. 189-206, 19 pages. Cited in co-pending related Japanese application.

† cited by third party

METALWORKING FLUID

This application is a CON of PCT/US2016/061051, filed Nov. 9, 2016 which claims benefit of 62/270,101 filed Dec. 21, 2015.

FIELD OF THE INVENTION

This invention relates to a fluid used as a coolant and lubricant for metalworking. Specifically, the invention relates to a metalworking fluid that is essentially free of boric acid and the salts thereof. The fluid is useful in metalworking (e.g., machining, milling, turning, grinding, forging, tube drawing, wire drawing, and the like) of various metals, such as cast iron and aluminum.

BACKGROUND OF THE INVENTION

Metalworking processes, such as cutting, generate heat due to friction. For example, in a milling process, a rotating cutting tool is used to methodically remove material from a metal workpiece and shape the metal workpiece into a final component. Friction is generated by the contact between the milling tool and the workpiece, causing increased temperature in the tool/workpiece contact areas. When manufacturing a large number of components, excessive heat generation during production must be controlled to protect the tool and work surface. Uncontrolled high temperatures may soften or degrade the integrity of the tools causing them to fail, damage the workpiece, or damage the finished component surface, by causing unwanted thermal expansion or oxidation of the metal. In order to remove the heat generated during metalworking processes, a fluid is applied to the tool/workpiece contact surfaces to efficiently and rapidly cool the tool and workpiece. The metalworking fluid also acts as a lubricant, which provides the advantage of reducing friction and tool wear. Flushing with the fluid removes metal chips from the contact surface. This enables faster and higher quality production of components with less scrap and reworking.

Many metalworking fluids are a mixture of water and oils to provide the cooling and lubrication functionality. Because these two fluids are immiscible, an emulsifier is commonly incorporated into the metalworking composition to ensure that the fluid remains well-mixed. The acidity/alkalinity of the metalworking fluid may affect the performance of the emulsifiers. Generally, a higher pH is preferred for optimal emulsifier performance, e.g. a pH of 8 or greater. An alkaline fluid having a pH of 9.0 or greater also provides the advantage of preventing bacteria growth in water-diluted metalworking fluid. Finally, some steel alloys can corrode at pH levels below 8.0, so keeping the pH near 9.0 can lessen corrosion on steel alloys in some cases.

In contrast, highly alkaline fluids may exhibit some disadvantages. For example, skin contact with the fluid may cause irritation, if the pH is 9.5 or higher. Heat and mechanical action of the metalworking process can create a mist of the metalworking fluid, and an operator may experience skin, eye, nose or throat irritation, if exposed to the mist when the pH is above 9.5. Also, certain metals do not tolerate high pH, such as some aluminum alloys and yellow metals (brass, copper, bronze). Aluminum or yellow metals can stain at highly alkaline pH levels, or even dissolve. Therefore, it is common to include additives in the metalworking fluid that act as a buffer and control the pH of the metalworking fluid, keeping pH above 8, and preferably within the range of 9 and 9.5.

Salts of boric acid and organic amines are commonly used to help buffer water-based metalworking coolants to a working pH of about 9.3 to promote antimicrobial performance and corrosion prevention. A drawback of boric acid however is that boric acid exposure is associated with some harmful health effects. Under the Globally Harmonized System of Classification and Labeling of Chemicals (GHS), products containing 5.5% or more of free boric acid need to be classified as "Toxic to Reproduction." The European Union REACH regulation requires that the presence of free boric acid be identified in safety data sheets for products containing greater than 0.1%. Due to the safety concerns associated with products containing boric acid, there is a need for an alternative pH buffer for metalworking fluids.

SUMMARY OF THE INVENTION

In a first embodiment of the present invention, a metalworking fluid comprises a pH buffer system, wherein the pH buffer system comprises one or more organic acids and one or more organic amines, wherein the organic acids are selected from the group consisting of aromatic carboxylic acids and $C_{10}$ or higher aliphatic carboxylic acids, and the one or more organic amines are selected from aliphatic and aromatic amines having an amine value of at least 50 mg KOH/g.

In one aspect of the present invention, the composition comprises 0.2 to 20% by weight of the one or more organic acids. The one or more organic acids may comprise at least one of a $C_{10}$-$C_{18}$ aliphatic acid and a $C_6$-$C_{30}$ aromatic dicarboxylic acid. The aromatic carboxylic acid of the one or more organic acids may have a structure of: HOOCR—($C_6H_4$)—R'COOH, R and R' being independently selected from $(CH_2)_a$, wherein $0 \leq n \leq 18$. Examples of the aromatic carboxylic acid include phthalic acid, isophthalic acid, and terephthalic acid. The one or more organic amines may be selected from monoethanolamine, methylpentamethylenediamine, and mixtures thereof.

In another aspect of the present invention, the metalworking fluid composition may have a pH in the range of 8.5 to 10.0.

In yet another aspect of the present invention, the metal working fluid composition may comprise about 0.1 to about 25% by weight of the one or more organic amines.

In yet another aspect of the present invention, the metal working fluid composition may further comprise at least one additive selected from the group consisting of a hydrodynamic lubricant, a boundary lubricant, an extreme pressure lubricant, a cast iron corrosion inhibitor, a yellow metal corrosion inhibitor, an aluminum corrosion inhibitor, an emulsifier, a hydrotrope, a biocide, and a defoamer.

In a second embodiment of the present invention, a metalworking fluid comprises a pH buffer that consists essentially of or may consist of one or more organic acids and one or more organic amines, wherein the organic acids are selected from the group consisting of aromatic carboxylic acids and $C_{10}$ or higher aliphatic carboxylic acids, and the one or more organic amines are selected from aliphatic and aromatic amines having an amine value of at least 50 mg KOH/g.

In a third embodiment of the present invention, a metalworking fluid composition comprises water, oil, and a pH buffer system, the pH buffer system consisting essentially of or may consist of one or more organic acids and an alkalinity agent comprising one or more organic amines, wherein the organic acids are selected from the group consisting of aromatic carboxylic acids and $C_7$ or higher aliphatic carboxylic acids, and the one or more organic amines are selected from aliphatic and aromatic amines having an amine value of at least 50 mg KOH/g.

In one aspect of the present invention, the alkalinity agent is selected from the group consisting of aminomethylpropanol (AMP-95), diglycolamine (DGA), monoethanolamine (MEA), monoisopropanolamine (MIPA), butyl ethanolamine (NBEA), dicylclohexylamine (DCHA), diethanolamine (DEA), butyldiethanolamine (NBDEA), triethanolamine (TEA), methylpentamethylenediamine, and combinations thereof, and optionally further comprises one or more of metal alkali hydroxides and metal carbonates and bicarbonates.

In another aspect of the present invention, the composition comprises 0.2 to 20% by weight of the one or more organic acids, which may comprise a $C_7$ to $C_{30}$ saturated or unsaturated carboxylic acid.

In a third embodiment, a method of metalworking is provided comprising shaping a metal workpiece by contacting a surface of the metal with a tool while cooling and lubricating at least one of the metal surface or tool with a metalworking fluid according to the present invention.

DETAILED DESCRIPTION OF THE INVENTION

According to embodiments of the present invention, an aromatic carboxylic acid, a $C_{10}$ or higher aliphatic carboxylic acid, or mixtures thereof may be used as an alternative to boric acid in a metalworking fluid to provide a less hazardous metalworking fluid.

For a variety of reasons, it is preferred that metal working fluids according to the invention may be substantially free from many ingredients used in compositions for similar purposes in the prior art. Specifically, it is increasingly preferred in the order given, independently for each preferably minimized ingredient listed below, that aqueous compositions according to the invention, when directly contacted with metal in a process according to this invention, contain no more than 1.0, 0.5, 0.35, 0.10, 0.08, 0.04, 0.02, 0.01, 0.001, or 0.0002 percent, more preferably said numerical values are in grams per liter, of each of the following constituents: boron, including but not limited to boric acid and salts thereof cadmium; nickel; cobalt; inorganic fluorides, chlorides & bromides; tin; copper; barium; lead; chromium; adipic acid and salts thereof; morpholine; nitrogen based acids and their salts, e.g. nitrates & nitrites; sulfur-based acids and their salts, e.g. sulfates & sulfites.

Other than in the operating examples, or where otherwise indicated, all numbers expressing quantities of ingredients, reaction conditions, or defining ingredient parameters used herein are to be understood as modified in all instances by the term "about". Throughout the description, unless expressly stated to the contrary: percent, "parts of", and ratio values are by weight or mass; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) between one or more newly added constituents and one or more constituents already present in the composition when the other constituents are added; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise, such counterions may be freely selected, except for avoiding counterions that act adversely to an object of the invention; molecular weight (MW) is weight average molecular weight; the word "mole" means "gram mole", and the word itself and all of its grammatical variations may be used for any chemical species defined by all of the types and numbers of atoms present in it, irrespective of whether the species is ionic, neutral, unstable, hypothetical or in fact a stable neutral substance with well-defined molecules; and the terms "storage stable" is to be understood as including dispersions that show no visually detectable tendency toward phase separation as well as those that show hard water precipitates of calcium and magnesium, but no phase water oil phase separation over a period of observation of at least 72, 96, 120, 150, 200, 250, 300, 320, or preferably at least 336, hours during which the material is mechanically undisturbed and the temperature of the material is maintained at ambient room temperatures (18 to 25° C.).

"Aromatic carboxylic acid" as used herein means acids and the salts thereof containing at least one aromatic ring per molecule (for example, a phenyl or naphthyl ring or a heteroaromatic ring) and one or more carboxylic acid groups (—COOH) per molecule, which may or may not be attached directly to an aromatic ring. The aromatic ring(s) may optionally be substituted with one or more substituents other than hydrogen and carboxylic acid groups, such as alkyl groups, alkoxy groups, halo groups and the like.

"$C_{10}$ or higher aliphatic carboxylic acid" as used herein means acids and the salts thereof of a molecule containing at least ten carbons in an unsaturated or saturated chain and one or more carboxylic acid groups (—COOH) per molecule, which may or may not be attached directly to the carbon chain. The carbon chain may optionally be substituted with one or more substituents other than hydrogen and carboxylic acid groups, such as alkyl groups, alkoxy groups, halo groups and the like.

When combined with an alkaline compound, such as an organic amine, the organic acid may provide a suitable pH buffer comparable to boric acid/organic amine buffer systems. Metalworking fluids according to the present invention preferably have a pH preferably that is at least, with increasing preference in the order given, 8.5, 8.6, 8.7, 8.8, 8.9, 9.0, 9.1, 9.2, 9.3, or 9.4 and independently preferably is not more than, with increasing preference in the order given, 10.0, 9.9, 9.8, 9.7, 9.6, or 9.5. For example, in certain embodiments, the metalworking fluid may have a pH of about 8.5 to 10.0, or more desirably a pH of 9.0 to 9.5. The organic acid incorporated in compositions according to the present invention has similar buffering capacity, anti-corrosive behavior, and stability in metalworking coolants, while avoiding the hazards associated with boric acid and its salts. Unlike other acids investigated for the purpose of replacing boric acid in metalworking fluids, the organic acid may be present in a relatively small amount in the metalworking fluid to function as a suitable pH buffer, thereby providing a less expensive alternative.

Thus, it is an aspect of the present invention to provide a metalworking fluid comprising a pH buffer system, wherein the pH buffer system comprises one or more organic acids and one or more organic amines.

In another embodiment of the present invention, a metalworking fluid comprises a pH buffer that consists essentially of one or more organic acids and one or more organic amines. Metalworking fluids according to the present invention reduce or eliminate boric acid as part of the pH buffer system, thus metalworking fluid compositions containing 0.1% by weight or more of boric acid would materially alter the basic and novel properties of the invention.

While not wishing to be bound by theory, it is believed that the metalworking fluids according to the various embodiments of the present invention are able to prevent or inhibit corrosion of the surfaces of metal workpieces by increasing the hydrophobicity of the surfaces. During metalworking, the elevated heat caused by friction between the metalworking tool and the metal workpiece surface may cause the alkaline portion of the buffering system, e.g. the organic amine, to volatize leaving a residue of the organic acid on the surface of the metal workpiece. The organic acids used in the metalworking fluids according to the present invention are preferably water insoluble or low in water solubility, so that their residue left on the metal workpiece surface provides a hydrophobic barrier to humidity to inhibit corrosion.

One or more of the organic acids is preferably a compound according to the following structure I:

(I)

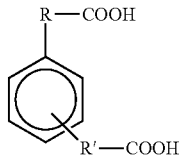

wherein R and R' are independently selected from $(CH_2)_n$, $0 \leq n \leq 18$. More preferably, one or more of the organic acids is selected from the group consisting of phthalic acid, isophthalic acid, and terephthalic acid, most preferably terephthalic acid.

In one embodiment, the one or more organic acids may comprise $C_7$-$C_{30}$, preferably $C_7$-$C_{18}$, most preferably $C_{10}$-$C_{18}$, saturated or unsaturated aromatic carboxylic acids, desirably diacids, preferably with the proviso that the acid is not adipic acid.

Metalworking fluids according to the present invention may preferably include at least, with increasing preference in the order given, 0.2, 0.4, 0.6, 0.8, 1.0, 1.1, 1.2, 1.3, 1.4, 1.5, 1.6, 1.7, 1.8, 1.9, 2.0, 2.5, 3.0, 3.5, 4.0, or 4.5% and independently preferably include not more than, with increasing preference in the order given, 20.0, 19.0, 18.0, 17.0, 16.0, 15.0, 14.5, 14.0, 13.5, 13.0, 12.5, 12.0, 11.5, 11.0, 10.5, 10.0, 9.8, 9.6, 9.4, 9.2, 9.0, 8.9, 8.8, 8.7, 8.6, 8.5, 8.4, 8.3, 8.2, 8.1, or 8.0% of organic acid based on the total weight of the metalworking fluid. For example, certain embodiments of the present invention may include about 0.2 to 20% of organic acid based on the total weight of the metalworking fluid, about 1 to 15%, or most desirably about 2 to 8%.

The organic acids of the present invention are intended to replace the boric acid found within the pH buffer system of prior metalworking fluids. The organic acids may therefore be combined with a suitable alkalinity agent in order to provide a buffer system that will maintain the metalworking fluid within a desired pH range. Examples of alkalinity agents that may be incorporated into a metalworking fluid singly or in combinations according to the present invention include, but are not limited, to alkanolamines; primary, secondary and tertiary amines, preferably primary amines, metal alkali hydroxides, e.g. potassium hydroxide, sodium hydroxide, magnesium hydroxide, lithium hydroxide; and metal carbonates and bicarbonates, e.g. sodium carbonate, sodium bicarbonate, potassium carbonate and potassium bicarbonate.

Suitable alkanolamines and amines include, but are not limited to, aminomethylpropanol (AMP-95), diglycolamine (DGA), monoethanolamine (MEA), monoisopropanolamine (MIPA), butylethanolamine (NBEA), dicylclohexylamine (DCHA), diethanolamine (DEA), butyldiethanolamine (NBDEA), triethanolamine (TEA), and methylpentamethylenediamine.

It is preferred that the alkalinity agent include at least one organic amine. "Organic amine" as used herein means a compound including at least one amine functional group. The compounds include primary, secondary, and tertiary amines of aliphatic and aromatic compounds. The organic amines are preferably aliphatic and have a total amine value of at least 50 mg KOH/g. Amine value is calculated according to ASTM 2074-92 (1998). Preferred organic amines include monoethanolamine and methylpentamethylenediamine.

Metalworking fluids according to the present invention may preferably include at least, with increasing preference in the order given, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, or 2.0% and independently preferably include not more than, with increasing preference in the order given, 25.0, 24.0, 23.0, 22.0, 21.0, 20.0, 19.0, 18.0, 17.0, 16.0, 15.9, 15.8, 15.7, 15.6, 15.5, 15.4, 15.3, 15.2, 15.1, or 15.0% of the one or more alkalinity agents based on the total weight of the metalworking fluid. For example, certain embodiments of the metalworking fluid may include one or more alkalinity agents in an amount of about 25% or less based on the total weight of the metalworking fluid, about 20% or less, or most desirably about 2 to 15%.

As previously noted, the pH buffer system incorporated into the metalworking fluids according to the present invention assists in improving the performance of emulsifiers in the metalworking fluid and prevents corrosion of certain metals. The pH buffer system is especially useful in metalworking fluid compositions comprising a mixture of aqueous fluids and oils, as well as optional additives that are typically incorporated into a metalworking fluid known by those having skill in the art. Desirably, the emulsifiers are selected such that the composition is storage stable as defined herein for at least three days or more.

The oils of the compositions according to the present invention serve as hydrodynamic lubricants. Hydrodynamic lubrication involves separating moving surfaces by a film of fluid lubricant. Oil-containing metalworking fluids, such as those of the present invention, typically include one or more soluble oils and semi-synthetic oils, as well as mineral oil as the primary lubricating ingredient, which also provides the advantage of some corrosion resistance. It is preferred that metalworking fluids according to the present invention include a mineral oil that is suitable for a wide range of operating conditions, e.g. temperature and pressure. Examples of suitable oils include, but are not limited to, hydrocarbon-based oils, such as naphthenic and paraffinic oils having low pour points, good solvency power, low odor levels, high flash points, and color stability characteristics.

Metalworking fluids according to the present invention may preferably include at least, with increasing preference in the order given, 0.5, 1.0, 1.5, 2.0, 2.5, 3.0, 3.2, 3.4, 3.6, 3.8, 4.0, 4.1, 4.2, 4.3, 4.4, 4.5, 4.6, 4.7, 4.8, 4.9, and 5.0% and independently preferably include not more than, with increasing preference in the order given, 50.0, 48.0, 46.0, 44.0, 42.0, 40.0, 39.0, 38.0, 37.0, 36.0, 35.0, 34.0, 33.0, 32.0, 31.0, 30.9, 30.8, 30.7, 30.6, 30.5, 30.4, 30.3, 30.2, 30.1 or 30.0% of the one or more hydrodynamic lubricants based on the total weight of the metalworking fluid. For example, certain embodiments of the metalworking fluid may include on or more hydrodynamic lubricants in an amount of about 50% or less based on the total weight of the metalworking fluid, about 40% or less, or most desirably about 5 to 30%.

As known by those of skill in the art, oil-containing metal working fluids may suffer some disadvantages, such as water hardness, which often impacts the fluid stability, excessive foaming during use due to the inclusion of emulsifiers, and microbial growth. Therefore, it is common to incorporate additional additives to overcome some of these disadvantages. Accordingly, metalworking compositions according to the present invention may optionally include one or more common additives, such as boundary lubricant additives, extreme pressure lubricant additives, corrosion inhibitors (e.g. cast iron, yellow metal, and aluminum corrosion inhibitors), emulsifiers/hydrotropes, biocides, and defoamers.

Boundary and extreme pressure lubricants minimize the frictional wear observed when surfaces rub together. Metalworking fluids according to the present invention may include one or more boundary and/or extreme pressure lubricant additives. Boundary lubricants may include, but are not limited to, soaps, amides, esters, glycols, and sulfated vegetable oils. Extreme pressure lubricants include, but are not limited to, chlorinated and sulfurized fatty acids and esters, polysulfides, organophosphates, and neutralized phosphate esters.

Certain polymeric materials, useful in the compositions according to the present invention, may also function as both boundary and extreme pressure lubricants including, but not limited to, block copolymers consisting of a central polyoxypropylene block with a polyoxyethylene chain at either end, block copolymers consisting of a central polyoxyethylene block with a polyoxypropylene chain at either end, tetrablock copolymers derived from the sequential addition of ethylene oxide and propylene oxide to ethylenediamine, ethylene oxide/propylene oxide copolymers having at least one terminal hydroxyl group, water-soluble lubricant base stocks of random copolymers of ethylene oxide and propylene oxide, a water-soluble polyoxyethylene or polyoxypropylene alcohol or a water-soluble carboxylic acid ester of such alcohol, alcohol-started base stocks of all polyoxypropylene groups with one terminal hydroxyl group, monobasic and dibasic acid esters, polyol esters, polyalkylene glycol esters, polyalkylene glycols grafted with organic acids, phosphate esters, polyisobutylenes, polyacrylonitriles, polyacrylamides, polyvinylpyrrolidones, polyvinyl alcohols and copolymers of acrylic acid or methacrylic acid and an acrylic ester.

Preferred boundary lubricants include alkalonamides and oleyl alcohol. Preferred extreme pressure lubricants include oleic acids and derivatives thereof, polyethylene glycol monoleyl ether phosphate, and phosphate esters.

Metalworking fluids according to the present invention may include one or more boundary lubricants in an amount of 0 to about 40% based on the total weight of the metalworking fluid, more preferably about 1 to 25%, and most preferably about 2 to 15%. Desirably, metalworking fluids according to the present invention may include one or more boundary lubricants in an amount of at least 1, 2, 3, 4, 5, 6, 7, 8, 9, 10, 11, 12, 13 or 14% based on the total weight of the metalworking fluid and up to about 15, 16, 17, 18, 19, 20, 21, 22, 23, 24, 25, 26, 27, 28, 29, 30, 31, 32, 33, 34, 35, 36, 37, 38, 39 or 40% based on the total weight of the metalworking fluid. Metalworking fluids according to the present invention may include one or more extreme pressure lubricants in an amount of 0 to about 40% based on the total weight of the metalworking fluid, more preferably about 5 to about 25% or less, and most preferably about 1 to about 5%. Desirably, metalworking fluids according to the present invention may include one or more extreme pressure lubricants in an amount of at least 1, 2, 3, 4, 5, 6, 7, 8, 9 or 10% based on the total weight of the metalworking fluid and up to about 11, 12, 13, 14, 15, 16, 17, 18, 19, 20, 21, 22, 23, 24, 25, 26, 27, 28, 29, 30, 31, 32, 33, 34, 35, 36, 37, 38, 39 or 40% based on the total weight of the metalworking fluid.

Corrosion inhibitors are chemical compounds that, when added in small concentration, stop or slow down the corrosion of metals and alloys. Oil-containing products rely heavily on the oil itself to form a barrier coating of corrosion protection; however depending on the metal being machined additional additives may be desired to further prevent the potential for corrosion. The corrosion inhibitors generally function by, for example, forming a passivation layer (a thin film on the surface of the material that stops access of the corrosive substance to the metal), inhibiting either the oxidation or reduction part of the redox corrosion system (anodic and cathodic inhibitors), or scavenging dissolved oxygen. Examples of corrosion inhibitors include, but are not limited to, alkylphosphonic acids, alkali and alkanolamine salts of carboxylic acids, undecandioic/dodecandioic acid and its salts, $C_4$-$C_{22}$ carboxylic acids and their salts, tolytriazole and its salts, benzotriazoles and its salts, imidazolines and its salts, alkanolamines and amides, sulfonates, alkali and alkanolamine salts of naphthenic acids, phosphate ester amine salts, alkali nitrites, alkali carbonates, carboxylic acid derivatives, alkylsulfonamide carboxylic acids, arylsulfonamide carboxylic acids, fatty sarkosides, phenoxy derivatives and sodium molybdate.

Preferred cast iron corrosion inhibitors include undecandioic/dodecandioic acid and its salts. Preferred yellow metal corrosion inhibitors include tolytriazole sodium salts. Preferred aluminum corrosion inhibitors include octanephosphonic acid.

Metalworking fluids according to the present invention may include one or more cast iron corrosion inhibitors in an amount of about 15% or less based on the total weight of the metalworking fluid, more preferably about 1 to 10%. Desirably, metalworking fluids according to the present invention may include one or more cast iron corrosion inhibitors in an amount of about 1, 2, 3, 4, 5, 6, 7, 8, 9 or 10% and not more than about 11, 12, 13 14 or 15%, based on the total weight of the metalworking fluid. Metalworking fluids according to the present invention may include one or more yellow metal and/or aluminum corrosion inhibitors each in an amount of about 5% or less based on the total weight of the metalworking fluid, more preferably about 3% or less, and most preferably about 0.1 to 0.5%. Metalworking fluids according to the present invention may include one or more yellow metal and/or aluminum corrosion inhibitors each in an amount of about 0.1, 0.2, 0.3 or 0.4% and not more than about 0.5, 1, 2, 3, 4 or 5%, based on the total weight of the metalworking fluid.

Any emulsifier or hydrotrope known to those skill in the art for the purpose of stabilizing a metalworking fluid emulsion may be utilized in the various metalworking fluid compositions according to the present invention. Suitable emulsifiers/hydrotropes include, but are not limited to, alkanolamides, alkylaryl sulfonates, alkylaryl sulfonic acids, amine oxides, amide and amine soaps, block copolymers, carboxylated alcohols, carboxylic acids/fatty acids, ethoxylated alcohols, ethoxylated alkylphenols, ethoxylated amines/amides, ethoxylated fatty acids, ethoxylated fatty esters and oils, ethoxylated phenols, fatty amines and esters, glycerol esters, glycol esters, imidazolines and imidazoline derivatives, lignin and lignin derivatives, maleic or succinic anhydrides, methyl esters, monoglycerides and derivatives, naphthenic acids, olefin sulfonates, phosphate esters, polyalkylene glycols, polyethylene glycols, polyols, polymeric (polysaccharides, acrylic acid, acrylamide), propoxylated & ethoxylated fatty acids, alcohols or alkyl phenols, quaternary surfactants, sarcosine derivatives, soaps, sorbitan derivatives, sucrose and glucose esters and derivatives, sulfates and sulfonates of oils and fatty acids, sulfates and sulfonates ethoxylated alkylphenols, sulfates of alcohols, sulfates of ethoxylated alcohols, sulfates of fatty esters, sulfonates of dodecyl and tridecylbenzenes, sulfonates of naphthalene and alkyl naphthalene, sulfonates of petroleum, sulfosuccinamates, sulfosuccinates and derivatives, tridecyl and dodecyl benzene sulfonic acids.

Preferred emulsifiers/hydrotropes include $C_{16}$-$C_{18}$ ethoxylated alcohols; alkyl ether carboxylic acids; tall oil distillation fractions; polyglycol ethers; and isononanoic acid.

Metalworking fluids according to the present invention may include one or more emulsifiers/hydrotropes in an amount of about 25% or less based on the total weight of the metalworking fluid, more preferably about 0.1 to about 20%, and most preferably about 1 to 15%. Emulsifiers/hydrotropes may be present in an amount of about 0.1, 0.5, 1, 2, 3, 4, 5, 6, 7, 8, 9, 10, 11, 12, 13, 14 or 15% and not more than about 16, 17, 18, 19, 20, 21, 22, 23, 24 or 25% based on the total weight of the metalworking fluid.

As previously mentioned, water-based fluids and fluids based on vegetable oils can be contaminated with bacteria and fungi. Bactericides or fungicides are sometimes added to metalworking fluids to control microbial growth and deterioration of the metalworking fluid. This is necessary to maintain the quality of the fluids and to protect workers from exposure to biological agents and endotoxins, causing machine operator's lung, hypersensitivity pneumonitis or Legionnaire's disease. Metalworking fluids based on pure mineral oils or solvent based fluids do not generally contain biocides, and the amount of biocides added to metalworking fluids varies depending on the type and use. However, to further prevent microbial growth in the metalworking fluids, one or more biocides may optionally be included in the metalworking fluid compositions according to the present invention. A suitable biocide for use in the inventive compositions is 2-pyridinethiol, 1-oxide, sodium salt.

Metalworking fluids according to the present invention may include one or more biocides in an amount of about 0.05 to 2% based on the total weight of the metalworking fluid, more preferably about 0.1 to 0.5%. Desirably, metalworking fluids according to the present invention may include one or more biocides in an amount of about 0.05, 0.06, 0.07, 0.08, 0.09, 0.1, 0.2, 0.3 or 0.4% and up to about 0.5, 0.6, 0.7, 0.8, 0.9, 1.0, 1.1, 1.2, 1.3, 1.4, 1.5, 1.6, 1.7, 1.8, 1.9 or 2% based on the total weight of the metalworking fluid.

Any compound that is compatible with the other components of the cutting fluid and will minimize or eliminate foaming of the metalworking fluid while the fluid is stored or in use may be used in the various embodiments of the present invention. Suitable defoamers include, but are not limited to, polyalkylenimines, organo-modified polysiloxanes, and polyethers. Exemplary defoamers include polyethyleneimine, alkyl polysiloxane such as dimethyl polysiloxane, diethyl polysiloxane, dipropyl polysiloxane, methyl ethyl polysiloxane, dioctyl polysiloxane, diethyl polysiloxane, methyl propyl polysiloxane, dibutyl polysiloxane and didodecyl polysiloxane; organo-phosphorus compound such as n-tri-butyl phosphate, n-tributoxy ethyl phosphate or triphenylphosphite, or a mixture therefore; and copolymers of poly alkylene oxide (ethylene oxide, propylene oxide and butylene oxide). Preferred defoamers include polyethyleneimine solutions and polymeric dispersions.

Metalworking fluids according to the present invention may include one or more defoamers in an amount of about 0.05 to 2% based on the total weight of the metalworking fluid, more preferably about 0.1 to 0.5%. Desirably, metalworking fluids according to the present invention may include one or more defoamers in an amount of about 0.05, 0.06, 0.07, 0.08, 0.09, 0.1, 0.2, 0.3 or 0.4% and up to about and up to about 0.5, 0.6, 0.7, 0.8, 0.9, 1.0, 1.1, 1.2, 1.3, 1.4, 1.5, 1.6, 1.7, 1.8, 1.9 or 2% based on the total weight of the metalworking fluid.

The components of the compositions according to the present invention may be combined or added in any order. Furthermore, any methods known to those of skill in the art commonly used for combining or mixing the various components of a metalworking fluid may be employed to produce fluids according to the present invention.

Metalworking fluids according to the present invention may be used in a variety of metalworking processes including, but not limited to, cutting, milling, turning, grinding, drilling, and boring. The metalworking fluids may be applied to the metal surfaces during the metalworking process, including the metal to be machined and/or the tools used to shape the raw material. Any method known by those of skill in the art to supply a metalworking fluid during a manufacturing process for the purpose of controlling heat generation and lubricating contact surfaces may be employed to apply metalworking fluids according to the present invention.

EXAMPLES

The invention is particularly described with reference to the following non-limiting examples giving the names of the different chemical components used in the compositions, their various proportions and evaluations of the performances of different embodiments of metalworking fluids according to the present invention.

Example 1

A first composition, Example 1, was prepared by combining the following chemical components in the amounts indicated in Table 1.

TABLE 1

Example 1 Composition

| Component | Purpose | Weight % |
|---|---|---|
| Water | Solvent | 41.70 |
| Mineral Oil | Hydrodynamic lubricant | 20.00 |
| Monoethanolamine | Organic amine pH buffer | 6.90 |
| Terephthalic acid | Organic acid pH buffer | 4.00 |
| Alkanolamide | Boundary lubricant | 7.25 |
| Sulfurized Oleic acid | Extreme pressure lubricant | 1.60 |
| Polyethylene glycol monooleyl ether phosphate | Extreme pressure lubricant | 3.0 |

TABLE 1-continued

| Example 1 Composition | | |
|---|---|---|
| Component | Purpose | Weight % |
| Alkoxylated Fatty Alcohol | Emulsifier | 1.0 |
| Alkyl ether carboxylic acids | Emulsifier | 1.5 |
| Tall oil distillation fractions | Emulsifier | 3.5 |
| Isononanoic acid | Hydrotrope | 0.5 |
| Dicyclohexylamine | Cast iron corrosion inhibitor | 6.0 |
| undecandioic/dodecandioic acid | Cast iron corrosion inhibitor | 2.0 |
| 1H-Benzotriazole, 4(or 5)-methyl, sodium salt solution | Yellow metal corrosion inhibitor | 0.25 |
| Octanephosphonic acid solution | Aluminum corrosion inhibitor | 0.25 |
| Polymer dispersion | Defoamer | 0.20 |
| Polyethyleneimine solution | Defoamer | 0.05 |
| Polyethyleneimine solution | Defoamer | 0.05 |
| 2-Pyridinethiol, 1-oxide, sodium salt solution | Biocide | 0.25 |

The physical characteristics of the fluid and a series of tests were performed on Example 1. The analytical results were compared to a benchmark commercially available metalworking fluid containing a pH buffer system that included boric acid. Observations and test results are provided in Table 2.

TABLE 2

| Analytical Results for Example 1 | |
|---|---|
| Test Description | Observation/Result |
| Initial Appearance Concentrate | Clear, transparent |
| Emulsion stability, 5 w/w% in 0, 10 and 20° dH water | All stable after sitting two weeks; hard water precipitate acceptable |
| Corrosion, Iron chip test, DIN 51360/2 | Equal to standard |
| Foam by blender test, ASTM D 3519, 7 w/w % in 6° dH water (no defoamer added) | Similar to standard |
| Stability, freezing—120° F. | Stable after one week |
| Copper corrosion, ASTM D130, 5 w/w % in tap water | Rating of 1a—Similar to standard |
| Buffering strength and initial pH by automatic titrator, 5 w/w % in tap water | Similar to standard |
| Falex Pin & V-Block, ASTM D 3233, Method A, 5 w/w % in DIW, steel #8 and #10 (Falex) | Equal to standard |

Two additional compositions, Examples 2 and 3, were prepared by combining the following chemical components in the amounts indicated in Tables 3 and 4. The resulting fluids performed similarly to the composition of Example 1.

TABLE 3

| Example 2 Composition | | |
|---|---|---|
| Component | Purpose | Amount (g) |
| Water | Solvent | 41.6 |
| Mineral Oil | Hydrodynamic lubricant | 20 |
| Monoethanolamine | Organic amine pH buffer | 7.2 |
| KOH, 45% (Caustic potash) | Inorganic alkalinity agent | 0.5 |
| Terephthalic acid | Organic acid pH buffer | 4 |
| Alkanolamide | Boundary lubricant | 4 |
| Oleyl alcohol | Boundary lubricant | 2 |
| Phosphate ester | Extreme pressure lubricant | 3 |
| Alkoxylated Fatty Alcohol | Emulsifier | 2 |

TABLE 3-continued

| Example 2 Composition | | |
|---|---|---|
| Component | Purpose | Amount (g) |
| Tallow alkyl polygylcol ether | Emulsifier | 2 |
| Polyoxyethylene (10) oleyl ether carboxylic acid | Emulsifier | 1 |
| Distilled tall oil fatty acids | Emulsifier | 2.2 |
| Isononanoic acid | Hydrotrope | 1 |
| undecandioic/dodecandioic acid | Cast iron corrosion inhibitor | 2 |
| Dicyclohexylamine | Cast iron corrosion inhibitor | 7 |
| 1H-Benzotriazole, 4(or 5)-methyl, sodium salt solution | Yellow metal corrosion inhibitor | 0.25 |
| 2-Pyridinethiol, 1-oxide, sodium salt solution | Biocide | 0.25 |

TABLE 4

| Example 3 Composition | | |
|---|---|---|
| Component | Purpose | Amount (g) |
| Water | Solvent | 40.9 |
| Mineral Oil | Hydrodynamic lubricant | 20 |
| Monoethanolamine | Organic amine pH buffer | 6 |
| Methylpentamethylenediamine | Organic amine pH buffer | 0.5 |
| KOH, 45% (Caustic potash) | Inorganic alkalinity agent | 0.25 |
| Terephthalic acid | Organic acid pH buffer | 5 |
| Sulfurized Oleic acid | Extreme pressure lubricant | 5 |
| Alcohols, fatty ethoxylated | Emulsifier | 3 |
| Alkyl ether carboxylic acids | Emulsifier | 2.5 |
| Tallow alkyl polyglycol ether | Emulsifier | 2.2 |
| Isononanoic acid | Hydrotrope | 1.5 |
| Polymer dispersion | Defoamer | 2 |
| Polyethyleneimine solution | Defoamer | 3.0 |
| Dicyclohexylamine | Cast iron corrosion inhibitor | 5.9 |
| undecandioic/dodecandioic acid | Cast iron corrosion inhibitor | 2 |
| 2-Pyridinethiol, 1-oxide, sodium salt solution | Biocide | 0.25 |

While preferred embodiments of the invention have been shown and described herein, it will be understood that such embodiments are provided by way of example only. Numerous variations, changes, and substitutions will occur to those skilled in the art without departing from the spirit of the invention. Accordingly, it is intended that the appended claims cover all such variations as fall within the spirit and scope of the invention.

What is claimed is:

1. A metalworking fluid composition comprising a mixture of water and mineral oil; at least two emulsifiers different from each other present in an amount sufficient to render the mixture storage stable for at least 72 hours of no water oil phase separation, and a pH buffer system, the pH buffer system comprising one or more organic acids and one or more alkalinity agents including one or more organic amines, wherein the organic acids are present in an amount of 0.2 wt % to 20 wt % and are selected from the group consisting of aromatic carboxylic acids selected from the group consisting of phthalic acid, isophthalic acid, terephthalic acid and combinations thereof, and the one or more organic amines are present in an amount of 0.1 wt % to 25 wt % and are selected from aliphatic and aromatic amines having an amine value of at least 50 mg KOH/g;

wherein the metalworking fluid contains at least one secondary amine; no boron; and the pH buffer system is present in an amount such that the metalworking fluid pH is maintained in a range of 9.0 to 10.0; and the one or more organic amines comprise at least one selected from the group consisting of monoethanolamine and a mixture of monoethanolamine with 2-methylpentane-1,5-diamine.

2. The metalworking fluid composition of claim 1, wherein the aromatic carboxylic acid comprises terephthalic acid; and the at least two emulsifiers comprise three or more emulsifiers different from each other.

3. The metalworking fluid composition of claim 1, wherein the aromatic carboxylic acid is terephthalic acid.

4. The metalworking fluid composition of claim 1, wherein the at least one secondary amine comprises dicyclohexyl amine (DCHA).

5. The metalworking fluid composition of claim 1, wherein the at least one secondary amine is selected from the group consisting of dicyclohexylamine (DCHA), diethanolamine (DEA), and combinations thereof.

6. The metalworking fluid composition of claim 1, wherein the composition has a pH maintained by the pH buffer system in the range of 9.0 to 9.5.

7. The metalworking fluid composition of claim 1, wherein the one or more organic acids further comprises at least one of a $C_{10}$-$C_{18}$ aliphatic acid and a $C_6$-$C_{30}$ aromatic dicarboxylic acid.

8. The metalworking fluid composition of claim 1, further comprising at least one additive selected from the group consisting of a hydrodynamic lubricant, a boundary lubricant, an extreme pressure lubricant, a cast iron corrosion inhibitor, a yellow metal corrosion inhibitor, an aluminum corrosion inhibitor, a hydrotrope, a biocide, and a defoamer.

9. The metalworking fluid composition of claim 1, wherein the one or more organic acids further comprising a $C_7$ to $C_{30}$ saturated or unsaturated carboxylic acid.

10. A method of metalworking comprising shaping a metal workpiece by contacting a surface of the metal workpiece with a tool while cooling and lubricating at least one of the metal surface or the tool with a metalworking fluid according to claim 1.

11. The metalworking fluid composition of claim 1, further comprising:

a. 2-15 wt. % of one or more boundary lubricants;
b. 1-5 wt. % of one or more extreme pressure lubricants;
c. 1-10 wt. % of one or more cast iron corrosion inhibitors;
d. 0.1-0.5 wt. % of one or more yellow metal and/or aluminum corrosion inhibitors;
e. 0.1-25 wt. % of one or more hydrotropes;
f. 0.05-2 wt. % of one or more biocides; and
g. one or more defoamers;

wherein the oil is present in an amount of about 0.5 to 50 wt. %.

12. The metalworking fluid composition of claim 1, wherein the terephthalic acid is present in an amount of about 2 wt. % to 10 wt. %;

wherein the one or more organic amines selected from the group consisting of monoethanolamine and a mixture of monoethanolamine with 2-methylpentane-1,5-diamine are present in an amount of about 2 wt. % to 15 wt. %;

the metalworking fluid composition further comprising:

1-15 wt. % of tallow alkyl polyglycol ether; and no more than 1 wt. % sulfur-based acids and their salts.

13. The metalworking fluid composition of claim 1, wherein the at least one organic amine further comprises at least one selected from the group consisting of 2-methylpentane-1,5-diamine; butyldiethanolamine (NBDEA); triethanolamine (TEA) and combinations thereof.

14. The metalworking fluid composition of claim 1, wherein the one or more organic acids is present in an amount of 0.2 to 8.2 wt % and the one or more organic amines are present in an amount of 0.3 to 15.0 wt %.

15. The metalworking fluid composition of claim 1, wherein the one or more organic acids is present in an amount of 2.0 to 8.0 wt % and the one or more organic amines are present in an amount of from 2.0 to 15.0 wt %.

* * * * *